US005380169A

United States Patent [19]

Eisenmann

[11] Patent Number: 5,380,169

[45] Date of Patent: Jan. 10, 1995

[54] SUCTION-CONTROLLED RING GEAR PUMP

[76] Inventor: Siegfried A. Eisenmann, Conchesstrasse 25, 7960 Aulendorf, Germany

[21] Appl. No.: 34,296

[22] Filed: Mar. 22, 1993

[30] Foreign Application Priority Data

Mar. 20, 1992 [DE] Germany ..... 4209143

[51] Int. Cl.[6] ..... F04B 49/00

[52] U.S. Cl. ..... 417/284; 417/441

[58] Field of Search ..... 417/284, 295, 310, 441

[56] References Cited

U.S. PATENT DOCUMENTS 5,096,397 3/1992 Eisenmann ..... 418/171

FOREIGN PATENT DOCUMENTS 3509856 10/1985 Germany .
3627414 2/1986 Germany .
3005657 1/1987 Germany .
3933978 8/1991 Germany .

*Primary Examiner*—Richard A. Bertsch
*Assistant Examiner*—Alfred Basichas
*Attorney, Agent, or Firm*—Renner, Otto, Boisselle & Sklar

[57] ABSTRACT

In a suction-controlled ring gear pump a continuous elimination of the vacuum occurring in the displacement cells of the pump at higher speed is achieved by a long distance of the displacement cells from the end of the suction region to the start of the outlet opening and the resulting diminishing of the displacement cells. To avoid squeeze oil when operating at low speed, the displacement cells following each other in the displacement direction between the gear teeth are each connected to the adjacent displacement cells by overflow passages which pass through the gear teeth and in which check valves prevent a flow against the displacement direction. To obtain an increased pump power when reaching specific operating parameters the flow resistance in the suction conduit can be reduced and the effective edge of the pressure kidney shifted forwardly by connection of a further preceding pressure kidney.

5 Claims, 4 Drawing Sheets

SUCTION-CONTROLLED RING GEAR PUMP

BACKGROUND OF THE INVENTION

1. Field of the Invention

The invention relates to a suction-controlled ring gear pump, in particular oil and/or hydraulic pump for motor vehicles and/or transmissions.

2. Description of the Prior Art

The drive of the pump is usually by the shaft carrying the pinion. Such pumps are used for example for supplying hydraulic systems. Such pumps are known from DE 39 33 978 C2 of Applicants. The latter corresponds to U.S. patent application Ser. No. 593,714, now U.S. Pat. No. 5,096,397, and Japanese patent application 3-175182.

Motor vehicle engines and transmissions in particular are operated in a wide speed range. The speed of rotation limit values may be in the relationship 10:1 or more.

In contrast, the nominal displacement of the lubricating pump of a motor vehicle engine, which with automatic transmissions must additionally perform the function of pressure supply of the hydraulic switching elements and the converter filling against cavitation, both in the case of the engine and in the case of the transmission, is substantially proportional to the speed of rotation only in the lower part of the operating range. In the upper speed range the oil requirement increases far less than the speed of the engine. Consequently, a drive-regulated lubricating or hydraulic pump or a pump with a displacement adjustable depending upon the speed is required.

The practical characteristic of the displacement with respect to the speed depends on a multitude of parameters, such as delivery pressure, oil viscosity, flow resistance in the suction and pressure conduit, configuration of the teeth of the gears, width of the gears and design of the pump. For approximate adaptation of the displacement curve to the requirement curve, for example of an internal-combustion engine, suction, regulation has been developed. By using correspondingly narrow suction conduits or by an orifice or in regulatable manner by a suction slide valve, the flow resistances in the suction pipe may be fixed so that a certain adaptation of the useful displacement of a gear pump to the requirement curve of the consumption is achieved. This is known for example from DE 36 27 414 A1. According to the latter three parallel suction conduits are provided, two of which have valves controlled in dependence upon operating parameters of the engine whilst a rigid orifice is disposed in the third suction conduit. DE 36 27 414 A1 describes by the way a ring pump of different type with filling piece. With this pump it is hardly possible to achieve satisfactory sealing of the cells with respect to each other where it is important, i.e. between filling piece and engagement point.

A disadvantage of this suction control is the cavitation which occurs. The latter leads to implosions of the gaseous constituents of the cell content so that undesired noises result, and, even worse, destructions of the cell walls.

To avoid these implosions, in the pressure region of the pump the cell content is given time by gradual reduction of the cells to increase the static pressure so that at the instant at which the cell enters into communication with the outlet passage, at least theoretically, no implosions of gas bubbles can occur because by this gradual reduction of the cell volume the bubbles have already condensed to liquid again or have dissolved in the liquid. The "slow" compression of the vapour and air spaces can be ensured constructionally in that on the displacement side of the pump the cells are connected to the displacement press,ire chamber initially only via check valves so that when a cell is not completely filled with fluid the displacement pressure cannot be effective therein.

If however the cells are already completely filled with fluid on the suction side, as is the case in the low speed range, the higher squeezing pressure in the cell opens the check valve in the direction of the pressure delivery space so that the displaced oil can flow into the pressure space with only slightly increased cell pressure compared with the delivery pressure corresponding to the opening pressure of the check valve and the flow resistance thereof. Such a construction is also known from DE 30 05 657 C2. In the latter axial bores leading to the outlet passage extend over the entire pressure half of the pump in the housing and contain spaced from the gear chamber check valves which open only when the pressure of the cell lying in front of the respective bore exceeds the pressure in the outlet passage. Accordingly, like the pump according to DE 36 27 414 A1, this pump has a large axial extent. The spring valves used may vibrate and break. Also, the irregular connection of the displacement cells to the outlet passage is disadvantageous. Finally, the pressure distribution is also disadvantageous as regards the use of cavitation-induced implosions.

These disadvantages are avoided in the pump of the type according to the application as set forth in DE 39 33 978 C2. In is short and has a small diameter, a favourable pressure profile in the pressure range, can be installed in existing constructions subsequently to replace the lubricating pump, is reliable in operation and has a simple construction. The housing is simply constructed and has only a small axial extent. Since each diminishing displacement cell can pass operating fluid only into the displacement cell in front, the pressure in each displacement cell is increased only gradually in the diminishing range until the pressure has reached the value at the outlet opening. A particular advantage here is that due to the passages with the ball valves a quite considerable flow resistance exists between the adjacent displacement cells. Preferably, the mouths of the inlet and outlet passages are arranged in the end walls of the gear chamber as so-called inlet and outlet kidneys. This permits very large influx and efflux cross-sections into and out of the displacement cells. The overflow passages may preferably be arranged in the teeth of the gears. The check valves may be formed as ball valves, the ball tending in each case to press against the valve seat due to the centrifugal force of the rotational movement of the gear containing the valves.

If in a suction-controlled ring gear pump the throttle in the inlet passage is controlled in such a manner that with increased fluid requirement the throttle cross-section is enlarged, for example by opening a throttle flap in a by-pass passage (DE 3 627 414 A1) (such a situation arises for example with the oil pump of a motor vehicle engine when an exhaust gas turbocharger is connected) in order to cause the displacement characteristic to become horizontal only at higher speed, the filling degree of the displacement cells in the suction range is increased with the opening of the throttle.

This results on the outlet side of the pump in an increased flow of the fluid through the overflow passages because the increased amount of fluid must be expelled. This leads to an impairment of the efficiency and to a reduction of the desired increase in the pump throughput.

SUMMARY OF THE INVENTION

The invention has as its object the avoiding of the aforementioned disadvantages in a pump of this type. In particular, the object of the invention is to reduce the pressure-side flow resistance with the throttle open in the suction passage and thereby improve the efficiency and throughput of the pump.

The invention therefore proposes in a suction-controlled ring gear pump, in particular oil and/or hydraulic pump for motor vehicle engines and/or transmissions, comprising a housing, an internally toothed hollow gear arranged rotatably in a gear chamber of the housing, a pinion which has one tooth less than the hollow gear, meshes with the latter and the teeth of which form together with the teeth of the hollow gear increasing and then diminishing displacement cells which follow each other and are sealed with respect to each other and are each connected to the adjacent displacement cells by overflow passages provided in the hollow gear and/or the pinion, check valves in the overflow passages which counteract a flow of the operating fluid opposite to the delivery direction, inlet and outlet passages arranged in the housing for the supply and discharge of the operating fluid which open into the gear chamber on both sides of the point of deepest tooth engagement, the end or the mouth of the discharge passage remote from the point of deepest tooth engagement being disposed so close to the point of deepest tooth engagement that between said end and the peripheral point at which the displacement cells start to diminish a plurality of diminishing displacement cells are continuously located, and a variable throttle arrangement provided in the inlet passage, the improvement in which at least one further mouth connected to the outlet passage is arranged spaced in front of the mouth of the outlet passage in the peripheral direction of the pump and is connected via a conduit to the outlet passage, the flow through said conduit is controllable by means of a throttle element and a control means is provided for the throttle arrangement and the throttle element.

In this manner, by the opening of the throttle in the outlet conduit the expulsion resistance of the pump is drastically reduced. With substantially filled displacement cells before the start of the diminishing thereof the fluid need no longer be displaced forwardly in the displacement direction through the overflow passages to compensate this diminishing. Depending upon the position of the further mouth, this forward displacement is rendered unnecessary because well before the range is reached the corresponding cells can expel into the additional outlet mouth via the outlet opening continuously communicating with the outlet passage provided that the throttle in the conduit connecting the additional outlet mouth to the outlet channel is open.

In the peripheral or revolving direction of the gears the distance of the further outlet opening from the outlet opening continuously communicating with the outlet passage should be at least equal to the extent of a displacement cell in said direction because otherwise, when the throttle in the outlet passage is closed, the further outlet opening would act like an extension of the continuously open outlet opening against the displacement direction. In this operating state this would lead to a considerable reduction of the distance and time necessary for the breakdown of cavitation bubbles.

In front of the further outlet opening in the conveying direction, a third outlet opening may be arranged with which a separate throttle element must then be associated. Said throttle element could be opened after reaching a still higher speed or after reaching another parameter value leading to a higher oil requirement. For simplicity of the construction and control, however, usually only one further outlet opening will be considered adequate.

Fundamentally, the throttle element in the discharge conduit from the further outlet opening may be an element opening and closing in continuous manner, for example a slide valve. Here as well, however, for simplicity a throttle element will be preferred which is switchable between a completely closed and a completely open position.

It is possible to configure the control means so that the throttle element in the inlet conduit is opened earlier than the throttle element in the pressure conduit. In this manner, three different operating states of the pump can be achieved. In the first state both throttle elements are closed. The pump operates normally as it does in the low speed range. In the second state only the throttle element in the suction passage is open. The pump now delivers more oil; i.e. the point at which the displacement or delivery characteristic changes from the form rising proportionally to the speed into an approximately horizontal form is shifted upwardly. If now with still further increasing throughput requirement for the pump the throttle element in the pressure conduit is also opened, the displacement of the pump will be further increased or the aforementioned bend point of the delivery characteristic shifted further upwardly.

However, in this case as well for simplicity it will be preferable for the control means to actuate the throttle elements synchronously and in the same sense.

When the control means switches to large throughput when a predetermined pump speed is exceeded or to small throughput when the speed drops below said value, it is advantageous for these two switch positions not to lie exactly at the same speed. The switching speed when the pump speed drops is preferably somewhat lower than the switching speed when the pump speed rises in order to avoid a frequent switching too and fro when operating the pump in the region of the critical speed.

The preferred field of use of the invention is the employment of the pump as oil and/or hydraulic pump for motor vehicle engines and/or transmissions, in particular automatic transmissions. The invention is however suitable for other uses, for example in hydraulic control systems.

BRIEF DESCRIPTION OF THE DRAWINGS

Further advantages and features of the invention will be apparent from the following description of preferred embodiments with the aid of the schematic drawings, wherein.

DESCRIPTION OF THE PREFERRED EMBODIMENTS

Figure 1:
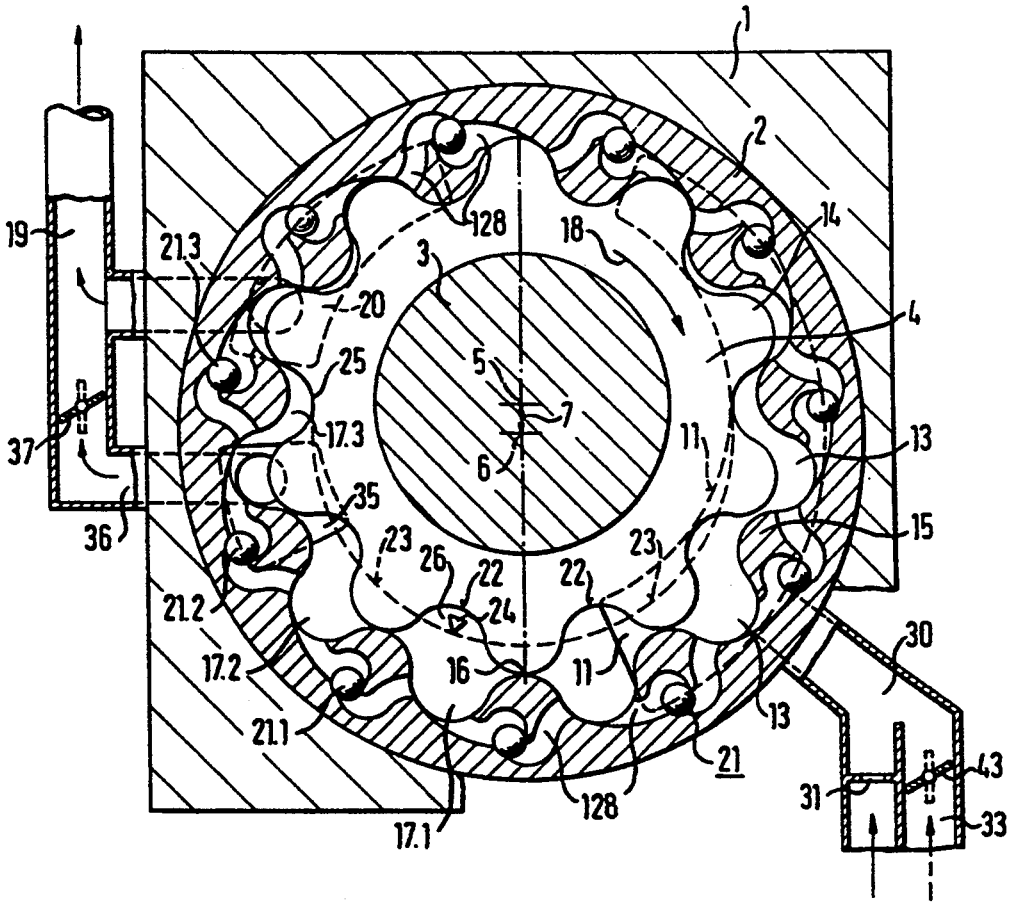
FIG. 1 shows a complete ring gear pump according to the invention, partially in section, in a plane normal to the axes of the gears through the hollow gear centre.

The pump shown in FIG. 1 comprises a pump housing 1 which is shown in simplified form and in the cylindrical gear chamber of which the hollow gear 2 is mounted with its periphery on the peripheral wall of the gear chamber. The shaft 3 carrying the pinion 4 of the ring gear pump is likewise mounted in the pump housing; in this respect however different mountings could be adopted. The pinion 4 has one tooth less than the gear 2 so that each tooth of the pinion is in continuous engagement with a tooth of the hollow gear, and as a result all the displacement cells 13 and 17 formed by the tooth gaps of pinion and hollow gear are continuously sealed with respect to the adjacent cells. The direction of rotation of the pump is clockwise as indicated by the arrow 18. The suction opening 11 is provided in the end wall of the gear chamber lying in FIG.1 behind the plane of the drawings. Said suction opening is supplied via the inlet passage 30 in which a throttle 31 is disposed. In the left half at the top the outlet opening 20 is shown. The suction and outlet opening are formed here as so-called "kidneys". The outlet conduit 19 adjoins the outlet openings 20.

The centre points 5 and 6 of the gears 4 and 2 have the axial spacing or eccentricity 7 which together with the circle diameters and the width of the gears is responsible for the geometrically specific displacement volume. These geometrical quantities define the steepness of the theoretical displacement line 109 of the pump shown in dashed line in FIG. 5. At low speed the suction velocity in the inlet passage 30 is small so that oil can flow in free of bubbles from the suction kidney 11 arranged laterally in the housing and extending almost over the entire suction peripheral region, because no appreciable partial vacuum occurs. The variation of the partial vacuum with respect to the speed is shown in FIG. 6 at 12. Since at low speed and tooth frequency the flow impedance between tooth and tooth gap is also small, the suction shells in the positions 13 between the meshing teeth 14 and 15 are filled with substantially bubble-free oil. As apparent from the drawings, the inlet passage mouth or suction kidney 11 extends in the peripheral direction closely up to the point 16 lying diametrically opposite the point of deepest tooth engagement. In the region of this point 16 the displacement cells formed by two oppositely disposed tooth gaps have reached their greatest volume and at low speed are filled completely with oil.

If the pump then turns further and the displacement cells come into the region on the left of the point 16 in FIG. 1, the cells in the positions 17 become displacement cells because the volume of the delivery cells drops from here up to the point of deepest tooth engagement continuously almost to the value zero.

Figure 2:
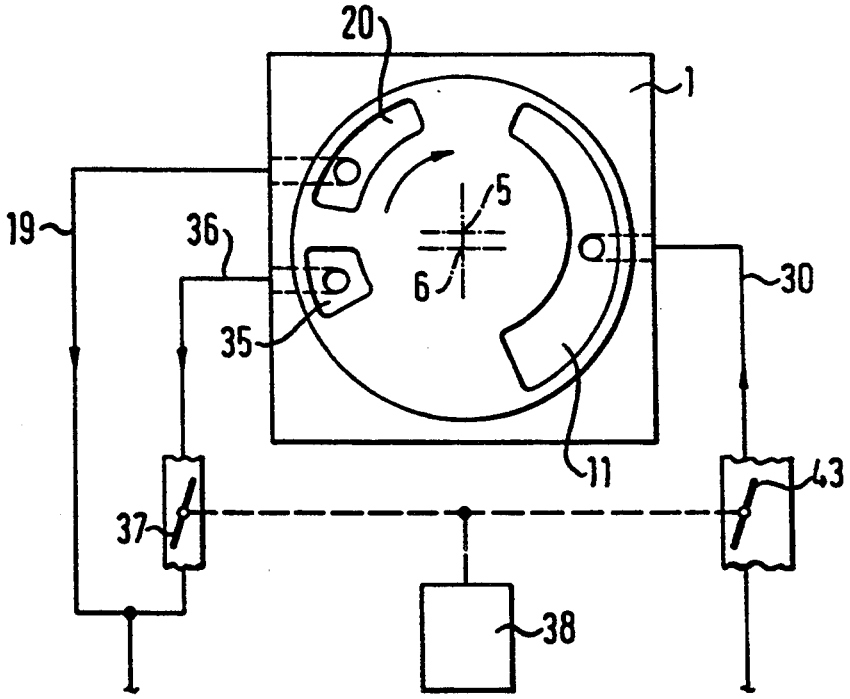
FIG. 2 shows schematically the circuit of the entire pump with the control means, the throttling in the suction conduit however being slightly different to FIG. 1.

In gear pumps of this type which are not suction controlled the outlet opening 20 may also extend close up to the point 16. The outlet opening and thus also the displacement cell in the first position 17.1 is thus already under full delivery pressure. In contrast thereto, in the pump according to the application the outlet opening of the gear chamber or the pressure kidney 20 are shortened to a great extent in the peripheral direction towards the point of deepest tooth engagement as can be seen in FIGS. 1 and 2. With a bubble-free oil filling, in the positions 17.1 to 17.3 the displacement cells must also be able to discharge correspondingly. This is made possible by the overflow passages 128 in the teeth of the hollow gear 10. Each overflow passage 128 is provided with a check valve 21. It can be seen that the displacement cells in the positions 17.1 to 17.3, in which their volume continuously decreases, can be discharged in the delivery direction towards the pressure kidney through the series-connected overflow passages 128 with the check valves 21.1 to 21.3 disposed therein. In the displacement cells in the positions 17.1 to 17.3 a somewhat higher static pressure must then obtain than in the pressure kidney 20 because the overflow passages 128 with the check valves 21 involve losses as regards the flow resistance. At low speed these losses are not high because the flow rates are small. These throttle losses should be kept as small as possible by appropriate design of the check valves.

The mouths of the overflow passages and/or the teeth and teeth gap form are of course arranged and dimensioned in such a manner that a liquid flow in the pump direction of rotation at the point of deepest tooth engagement is prevented. This does not present any difficulties.

Figure 5:
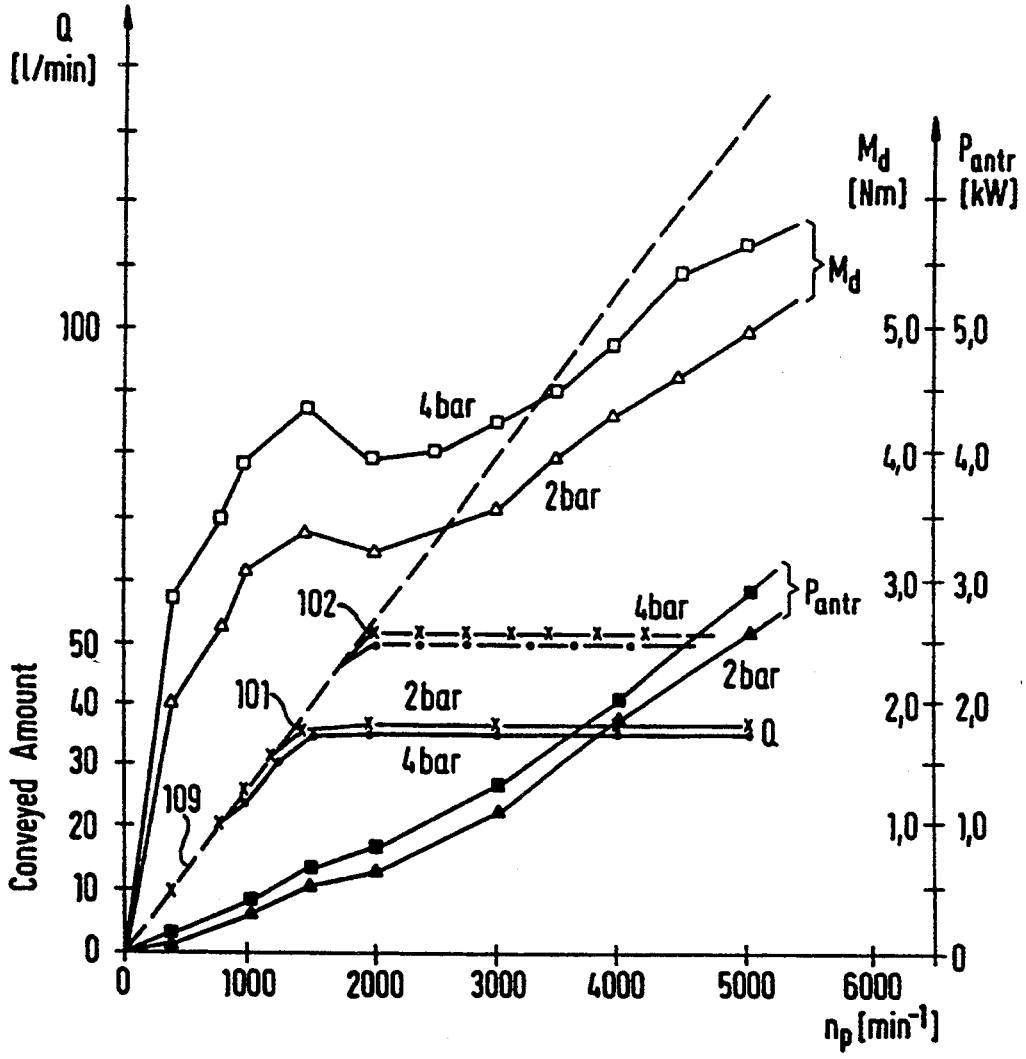
FIG. 5 shows the delivery characteristic for the pump according to FIG. 1.
Figure 6:
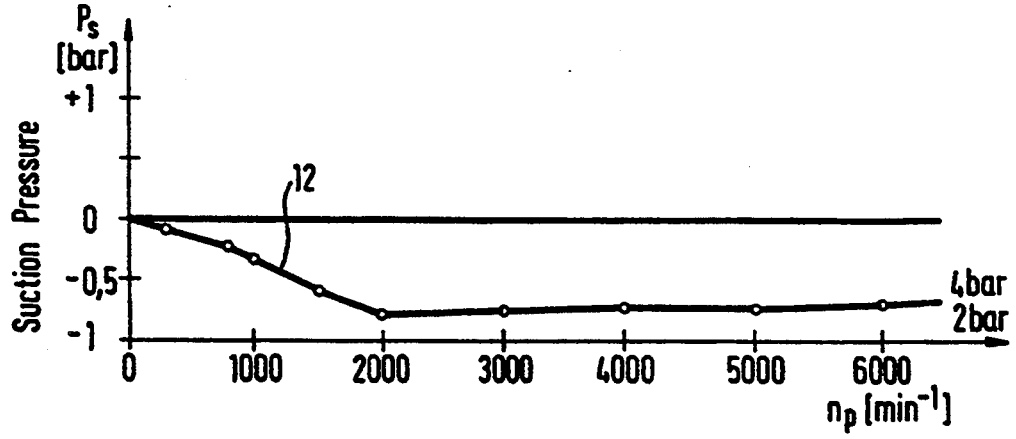
FIG. 6 shows the variation of the suction pressure with respect to speed for the pump according to FIG. 1.

Thus, up to a certain limit speed 101 in FIG. 5 a displacement amount proportional to the speed is fundamentally available. If this limit speed is exceeded, the static pressure in the inlet conduit begins to drop and falls below a critical value, as is best apparent in FIG. 6. In the latter, in the pump investigated this speed range is about 1200 rpm. From 1450 rpm the displacement remains constant in spite of increasing speed because the static suction pressure has dropped below the evaporation pressure of the oil. From this point on cavities arise in the displacement cells in the positions 13 which are concentrated theoretically in the region of the root circle of the pinion 4, i.e. at 22, since the bubble-free oil is forced radially outwardly by centrifugal force. At about 2100 rpm the pump delivers only about $\frac{2}{3}$ of its maximum displacement volume, as apparent from FIG. 5. This state is indicated in FIG. 1 by a dashed level line 23 as circle concentric with the hollow gear centre point. This level line 23 is provided with the level reference numeral 24. Radially within the level line there is essentially oil vapour and/or air and radially outside essentially oil. The level line 23 passes through the root point 25 of the pinion tooth gap of the displacement cell in the position 17.3 which is just about to come into communication with the pressure kidney or outlet opening 19. The pump is advantageously so designed that even at the maximum operating speeds to be expected the level line does not move appreciably further radially outwardly than the root point of the pinion tooth gap of the displacement cell which is just reaching the edge of the outlet opening 20. This level line can of course always lie radially further inwardly if this is not detrimental to the suction control.

Since the displacement cells in the positions 17.1 to 17.3 are sealed with respect to each other by tooth flanks or tooth tip engagement and the check valves in the design shown are closed not only by the centrifugal force acting on time valve ball on the one hand but also by the static pressure rising from the cell positions 17.1 through 17.2 to 17.3, the displacement pressure in the outlet opening 20 cannot act into the displacement cells in the positions 17.1 to 17.3. The cavities 26 within the level ring surface 23 thus have enough time to break down by cell volume reduction before reaching the position 17.3.

In so far as described hitherto regarding the example of embodiment, the pump is known from DE 39 33 978 C2.

The objective of the invention is now to shift to a position 102 lying further upwardly the point at which the displacement characteristic 109 bends into the horizontal in FIG. 5 on reaching a corresponding parameter of the means fed by the pump, i.e. in particular an internal-combustion engine or an automatic motor vehicle transmission.

The invention achieves this in that in the example of embodiment according to FIG. 1 a by-pass passage 33 is associated with the inlet passage leading to the orifice 31 and in said by-pass passage a throttle flap 43 is disposed which can be adjusted between a blocking position shown in full line in FIG. 1 and a position releasing the flow through the passage 33 shown in dashed line. Furthermore, the pressure or discharge passage 19 is supplied not only from the pressure kidney 20 but also from an outlet opening 35 which precedes said pressure kidney 20 and which is connected via the passage 36 to the outlet passage 19 in the manner shown in FIG. 1. There is also a throttle flap 37 in the passage 36 and this flap can be switched between a position blocking the passage 36 and shown in full line in FIG. 1 and a position freeing the flow through said passage 36 and shown in dashed line in FIG. 1. It will be assumed that the pump is the lubricating oil pump of a motor vehicle drive engine which can be brought to higher power by connection of an exhaust gas turbocharger. In the normal operating state the two throttle flaps 43 and 37 are closed. The pump now operates in the usual manner as suction-control pump. Its displacement characteristic 109 bends in the region of the point 101 into the horizontal. If now greater oil amounts are required, because the exhaust turbocharger is connected, the control means 38 indicated only schematically in FIG. 2 switches the two throttle flaps 43 and 37 from the closed position into the open position. As a result, firstly the suction resistance is greatly reduced and the level line 23 is shifted correspondingly outwardly. This means that in FIG. 5 the bend point of the displacement characteristic line shifts from the position 101 to the position 102. Since with the switching of the throttle flap 43 the throttle flap 37 was also switched, it is not necessary here to displace the relatively large amount of oil additionally through the overflow passages 128 forwardly up to the start of the outlet kidney 20. 0n the contrary, via the passage 36 and the additional outlet opening 35 the functionally decisive edge of the "outlet opening" in FIG. 1 now lies far closer to the point 16. In this manner throttle losses which would otherwise occur in the overflow passages 128 are reduced to a minimum. The efficiency of the pump is also increased and the delivery rises substantially linearly until the speed of the engine has reached the position 102 in FIG. 5.

In FIG. 5 the drive power Pantr and the torque absorbed Md are also shown. All the values are shown both for a pump pressure as 2 bar and for a pump pressure of 4 bar. In FIG. 2 the throttle arrangement in the inlet passage 30 is shown somewhat different to FIG. 1 to indicate that the invention is not restricted to the arrangement of a throttle flap parallel to a rigid throttle. Thus, for example, as shown in FIG. 2 a throttle flap 43 may be used which is switchable not between a completely closing and completely opening position but between an only partially closing and a completely opening position. In this manner the separate by-pass passage 33 and the rigid orifice 31 may be dispensed with because the throttle flap performs these two functions simultaneously.

As previously described, in the embodiment according to FIG. 1 or 2 the two throttle flaps 33 and 37 may act functionally as shutoff valves. They may however also be continuously adjustable in a corresponding control so as to cope with a continuously varying fluid demand. Then, in FIG. 5 the bend point does not jump from 101 to 102 and back but can assume any desired position between said two points.

Figure 3:
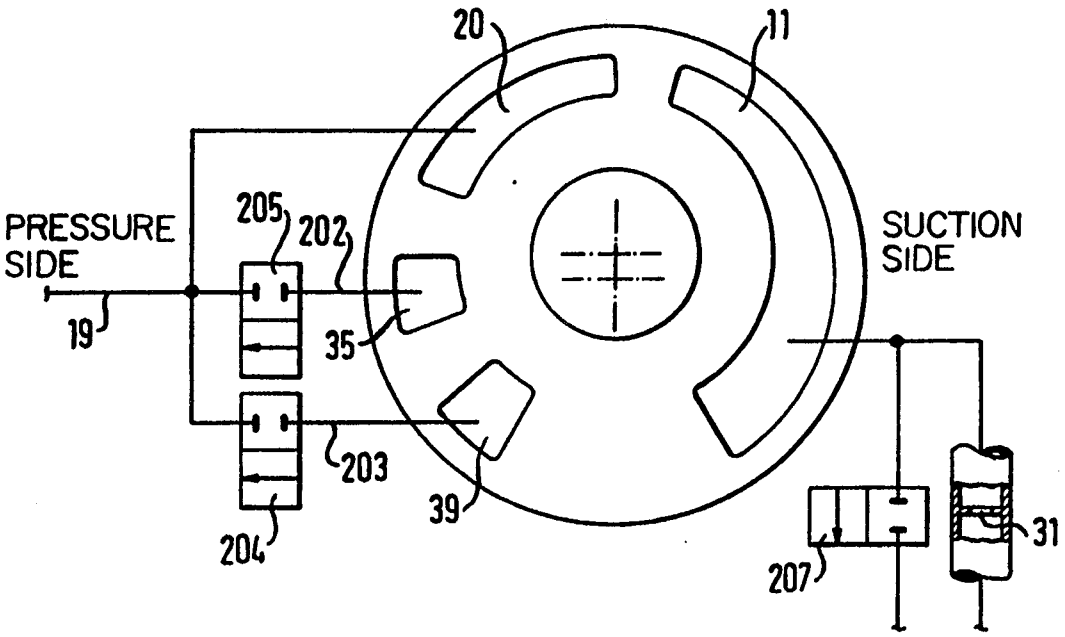
FIG. 3 shows the end wall of the pump chamber with the inlet and discharge openings and the corresponding throttle means for a construction of the pump having a total of three outlet openings in the pressure region.

As apparent from FIG. 3, in the invention it is also possible to provide a further pressure kidney 39 in addition to the preceding pressure kidney 35; said pressure kidney 39 is then arranged another corresponding distance in front of the pressure kidney 35. Via a conduit 293 and a shutoff valve 204 disposed therein the pressure kidney 39 then supplies the pressure conduit 19. In this example of embodiment the throttles 37 and 43 of the example according to FIG. 1 are also replaced by shutoff valves 205 and 207.

Figure 4:
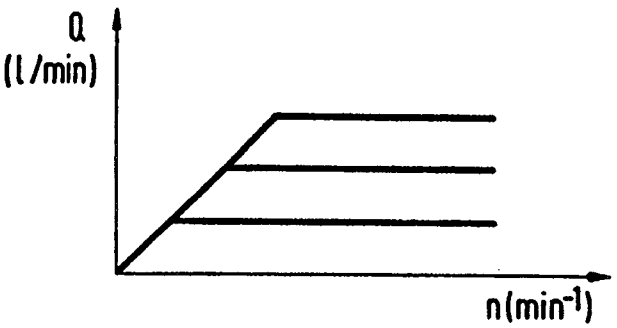
FIG. 4 is a schematic profile of the delivery characteristic with different switching states of the throttles according to FIG. 3.

In this embodiment, after the opening of the two shutoff valves 205 and 207 which has led to shifting the point at which the displacement characteristic merges into the horizontal upwardly into the centre position shown in FIG. 4, when the oil requirement is still further increased by opening the shutoff valve 204 the point at which the linearly rising displacement characteristic merges into the horizontal can be shifted still further upwardly, as likewise illustrated in FIG. 4.

I claim:

1. A suction-controlled ring gear pump, in particular oil and/or hydraulic pump for motor vehicle engines and/or transmissions, comprising a housing, a hollow gear, having a plurality of teeth, arranged rotatably in a gear chamber of the housing, a pinion meshing with the hollow gear and having a plurality of teeth one less in number than the teeth of the hollow gear, the teeth of the pinion forming together with the teeth of the hollow gear alternately increasing and then diminishing displacement cells for a fluid being pumped that are sealed by the teeth with respect to each other, and each displacement cell being connected to the adjacent displacement cells by respective overflow passages provided in at least one of the hollow gear and the pinion, check valves in the overflow passages which counteract a flow of the fluid opposite to a delivery direction, the delivery direction being the direction of flow of the fluid being pumped, inlet and outlet passages arranged in the housing for the supply and discharge of the fluid which open into the gear chamber on both sides of the point of deepest tooth engagement, the end of a first mouth of the outlet passage remote from the point of deepest tooth engagement being disposed so close to the point of deepest tooth engagement that between said end and the peripheral point at which the displacement cells start to diminish a plurality of diminishing displacement cells are continuously located, and a variable throttle arrangement provided in the inlet passage, wherein at least one further mouth connected to the outlet passage is arranged spaced in from of the first mouth of the outlet passage in the peripheral direction of the pump and is connected via a conduit to the outlet passage, the flow through said conduit is controllable by means of a throttle element and a control means is provided for the throttle arrangement and the throttle element.

2. A ring gear pump according to claim 1, wherein the control means actuates the throttle element and the throttle arrangement synchronously and in the same direction.

3. A ring gear pump according to claim 1, wherein the control means switches the throttle element and the throttle arrangement between two respective positions.

4. A ring gear pump according to claim 1, wherein the control means switches to large throughflow on exceeding a first predetermined pump speed and to small throughflow when the speed drops below a second predetermined pump speed less than said first predetermined pump speed.

5. A ring gear pump according to claim 1, wherein the flow through the conduit can be shutoff by means of the throttle element.

* * * * *